US005513421A

United States Patent [19]

Wells

[11] Patent Number: 5,513,421

[45] Date of Patent: May 7, 1996

[54] CABLE TIE HAVING AN IMPROVED STRAP LOCKING DEVICE

[75] Inventor: Peter M. Wells, Germantown, Tenn.

[73] Assignee: Thomas & Betts Corporation, Memphis, Tenn.

[21] Appl. No.: 227,942

[22] Filed: Apr. 15, 1994

[51] Int. Cl.[6] ..... B65D 63/14

[52] U.S. Cl. ..... 24/16 PB; 24/30.5 P

[58] Field of Search ..... 24/16 R, 16 PB, 24/30.5 R, 30.5 P, 17 AP; 248/74.3; 292/318, 322

[56] References Cited

U.S. PATENT DOCUMENTS

| | | | |
|---|---|---|---|
| 3,102,311 | 9/1963 | Martin et al. | 24/16 PB |
| 3,186,047 | 6/1965 | Schwester et al. | 24/16 PB |
| 3,408,699 | 11/1968 | Reynolds . | |
| 3,457,598 | 7/1969 | Mariani | 24/16 PB |
| 3,588,961 | 6/1971 | Farago | 24/16 PB |
| 3,588,962 | 6/1971 | Feldberg | 24/16 PB |
| 3,590,422 | 7/1971 | Geisinger . | |
| 3,735,448 | 5/1973 | Waddington | 24/16 PB |
| 3,965,538 | 6/1976 | Caveney et al. | 24/16 PB |
| 4,754,529 | 7/1988 | Paradis | 24/16 PB |
| 5,121,524 | 6/1992 | Mortensen | 24/16 PB |
| 5,146,654 | 9/1992 | Caveney . | |
| 5,193,251 | 3/1993 | Fortsch | 24/16 PB |
| 5,267,373 | 12/1993 | Chisek | 24/16 PB |
| 5,295,285 | 3/1994 | Shely | 24/16 PB |

FOREIGN PATENT DOCUMENTS

| | | |
|---|---|---|
| 244876 | 11/1987 | European Pat. Off. . |
| 592162 | 4/1994 | European Pat. Off. . |

*Primary Examiner*—James R. Brittain
*Attorney, Agent, or Firm*—Salvatore J. Abbruzzese

[57] ABSTRACT

A cable tie includes an elongate generally planar strap and a cable tie head. The head of the cable tie includes an aperture therethrough for insertably accommodating the strap. A locking device is supported by the head and extends into the aperture. The locking device permits movement of the strap in an insertion direction and prevents substantial movement of the strap in a withdrawal direction. The locking device includes a hingedly mounted support member extending into the aperture and a barb supported adjacent the support member. The barb and the support member are movable into locking engagement with the strap to prevent withdrawal of the strap from the head aperture.

20 Claims, 4 Drawing Sheets

CABLE TIE HAVING AN IMPROVED STRAP LOCKING DEVICE

FIELD OF THE INVENTION

The present invention relates generally to ties used to bundle an article or a group of articles. More particularly the present invention relates to a cable tie having an improved locking barb support structure which facilitates securement of the strap in the head of the cable tie.

BACKGROUND OF THE INVENTION

Use of cable ties to bundle or secure a group of articles such as electrical wires or cables is well known. U.S. Pat. No. 3,102,311 is an early example of straps used for such purposes.

Known cable ties of conventional construction are elongate members having a head at one end, a tail at the other end and a longitudinal strap therebetween. The strap is wrapped around a bundle of articles and the tail is inserted through an aperture or passage in the head. The head of the cable tie typically includes a locking element which is engagable with the body of the strap so that when the tail is pulled through the head aperture, the locking element secures the strap body in the head.

Advances in cable tie construction have taken many forms and shapes. However, since the initial introduction of cable ties, the development of self-locking devices carried in the cable tie head have taken basically two divergent paths.

One approach has been to form an integral one-piece plastic cable tie where the locking element is formed integrally with the head of the cable tie. An example of an integrally formed one-piece cable tie is shown in U.S. Pat. No. 3,965,538. One advantage of such an integrally formed one-piece cable tie is that the tie exhibits relatively low insertion force. That is, it is relatively easy to insert the tail of the tie through the head aperture. An integrally formed flexibly supported pawl forming the locking element facilitates such ease of insertion.

A second distinct approach used to form cable ties has been the use of a cable tie having a metallic barb embedded into the cable tie head at an acute angle with respect to the inserted tail. The metal barb permits insertion of the cable tie strap through the head aperture but bites into the strap upon an attempt to withdraw the strap therefrom. An example of a cable tie having such construction is shown and described in U.S. Pat. No. 3,186,047. As the metal barb of the cable tie actually bites into the inserted tail preventing withdrawal, cable ties of this construction exhibit high long-term pull-out resistance. This results in the cable tie having good loop tensile strength over time which is an important criteria in the selection and use of cable ties.

The cable tie art has also seen attempts to obtain the benefits of both an integrally molded one-piece cable tie and those of the two-piece cable tie having an embedded metallic barb. One such attempt at a multiple piece cable tie is seen in U.S. Pat. No. 5,121,524 where the cable tie is formed to have a head including a hingedly mounted pawl which holds a metallic barb therein. The pawl is flexibly rotatably movable within the head upon insertion of the strap. The metal barb supported by the pawl bites into the strap upon attempted withdrawal of the strap. A further example of the combination of the two technologies is shown in U.S. Pat. No. 5,193,251 where the head of the cable tie includes a metallic barb supported on a cantilevered platform. The platform is deflectable upon insertion of the strap through the aperture to permit ease of passage therethrough. The barb is positioned for biting insertion into the strap upon an attempt to withdraw the strap from the aperture.

While the cable ties shown in each of these patents attempts to provide the advantages of both types of cable tie technology, there is still a need to provide a cable tie which exhibits high long-term loop tensile strength as well as low strap insertion force.

SUMMARY OF THE INVENTION

It is an object of the present invention to provide an improved cable tie of the type including an elongate strap, a head at one end thereof and locking means in the head for securing the strap.

It is a further object of the present invention to provide a cable tie having an improved locking device support structure which facilitates easy insertion of the strap into the head and prevents withdrawal of the strap from the head.

It is a still further object of the present invention to provide a cable tie having a locking barb supported in the head by a hinged support member where the barb and the support member are movable into locking engagement with the strap to prevent withdrawal of the strap from the head aperture.

In the efficient attainment of these and other objects the present invention provides a cable tie having an elongate generally planar strap. A head having an aperture therethrough insertably accommodates the strap. A locking device is supported by the head and extends into the aperture. The locking device permits movement of the strap in an insertion direction and prevents substantial movement of the strap in a withdrawal direction opposite the insertion direction. The locking device includes a hingedly mounted supported member extending into the aperture and a barb supported by the support member. The barb and the support member are movable into locking engagement with the strap to prevent withdrawal of the strap in the withdrawal direction.

As particularly shown by way of the preferred embodiment herein, the cable tie of the present invention includes a metallic barb having a knife-like edge for biting engagement with the strap body upon an attempt to move the strap body in the withdrawal direction. The hingedly mounted support member is integrally formed with the cable tie head and permits movement of the barb so as to permit easy insertion of the strap in the insertion direction.

DETAILED DESCRIPTION OF THE PREFERRED EMBODIMENTS

Figure 1:
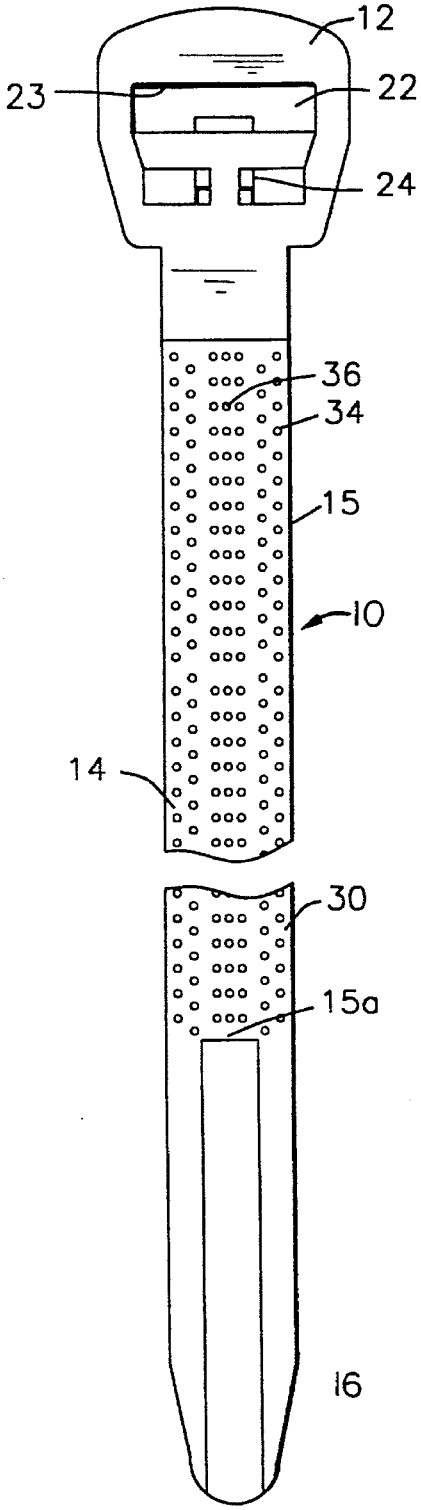
FIG. 1 is a bottom plan view of an improved cable tie of the present invention.
Figure 2:
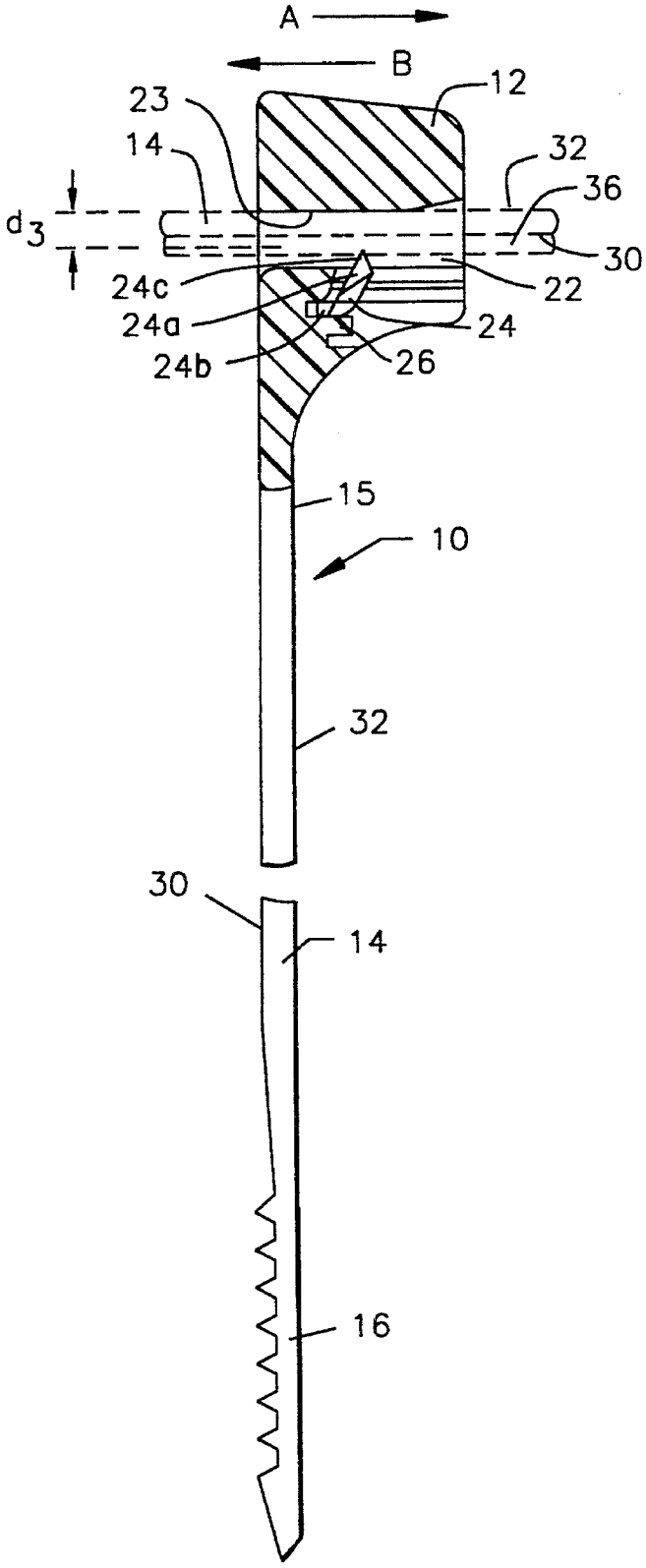
FIG. 2 is a side elevational view, partially in section of the cable tie of FIG. 1.

Referring to FIGS. 1 and 2, a cable tie 10 of the present invention is shown. Cable tie 10 is typically an elongate molded plastic member which is used in a manner which is well known in the art to wrap around a bundle of articles such as electrical wire or cable (not shown). Cable tie 10 may be molded from a high strength plastic such as nylon or polypropylene and is suitable for both indoor and outdoor use. Cable tie 10 has a head 12 at one end thereof, a depending strap 14 extending from head 12 and a tail 16 at the end opposite of head 12. In the present and illustrative embodiment head 12 is formed as an integral portion of cable tie 10. However, in certain applications cable tie 10 may be constructed in a manner where head 12 is formed separately from strap 14.

Head 12 of cable tie 10 includes a central passage 22 therethrough which insertably accommodates tail 16 and strap 14 therein. Central passage 22 is defined by an upper wall 23 against which tail 16 may be inserted. Cable tie 10 further includes a metallic locking barb 24 supported in head 12 which engages strap 14 after it has been coiled around the bundle of articles to lock strap 14 in place around the bundle. The barb 24 of the embodiment of FIGS. 1 and 2 is preferably formed of stainless steel and includes a knife-like tail engagement portion **24*a* extending into passage 22. The barb 24 further includes a mounting portion 24*b* which is supported on a flexible support hinge 26 which is molded integrally with head 12**.

Flexible support hinge 26 permits insertion of tail 16 through passage 22 by deflecting in a cantilevered manner to permit passage of tail 16 and strap 14 therethrough. The passage of strap 14 is shown by phantom lines in FIG. 2.

Common in barb type cable ties of the prior art, the barb is positioned in the head such that it engages the strap upon insertion in order to provide biting engagement with the strap upon an attempt to withdraw the strap. While providing superior withdrawal strength, this engagement also has the tendency to increase the force necessary to insert the strap into the head.

Figure 3:
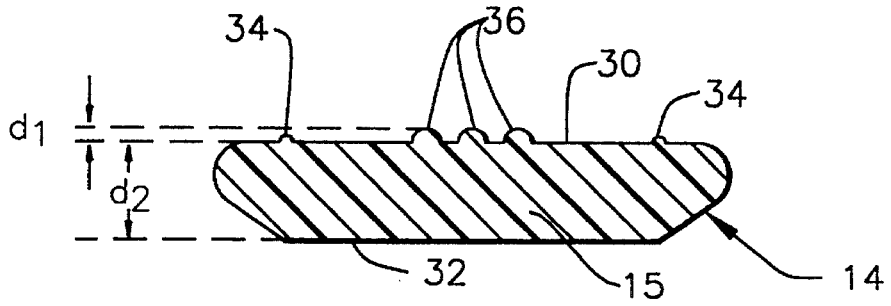
FIG. 3 is a enlarged transverse cross-section of the strap of the cable tie of FIG. 1.

Referring specifically to FIGS. 1–3, an improvement in strap body design facilitates easy insertion of strap 14 through passage 22 of head 12. Strap 14 generally defines a planar strap body 15 between a pair of opposed elongate planar surfaces 30 and 32. Strap body 15 is constructed so that the thickness, as measured between opposed planar surfaces 30 and 32, is not substantially greater than the distance between wall 23 defining passage 22 and the distal extent **24*c* of barb 24 (FIG. 1). Thus, upon insertion of strap body 15 through passage 22 (arrow A, FIG. 2), the strap body is not in substantial engagement with barb 24. Preferably the dimension of strap body 15 between surfaces 30 and 32 is selected so there is no engagement between barb 24 and strap body 15. However, manufacturing tolerance may not preclude slight engagement therebetween. This slight engagement would not significantly increase the force necessary to insert strap 14 into passage 22. As there is at most only slight engagement between strap body 15 and barb 14 upon insertion, strap 14 is further modified as described hereinafter so that upon an attempt to withdraw strap 14 from passage 22 (arrow B, FIG. 2), the barb 14 will still bite into strap 14 securing the strap 14 in passage Strap 14 includes a pattern of protrusions which extend from surface 30 along the width of strap body 15. A series of first protrusions 34 are positioned in two pairs of transversely spaced longitudinally extending rows along each lateral edge of surface 30. Protrusions 34 extend a short distance above surface 30 and are provided primarily to contact the bundle of wires or cables (not shown) when strap 14 is wrapped therearound. This frictional engagement between protrusions 34** and the wire bundle prevents the strap from rotating or revolving around the bundle during securement.

A series of second protrusions 36 are more centrally located and as shown in FIGS. 1 and 3 are arranged in three longitudinally extending transversely spaced rows along a central longitudinal strip **15*a*. The protrusion may be transversely aligned or may be arranged in staggered fashion. In addition to frictionally engaging the wire bundle in a manner similar to that of protrusions 34, protrusions 36 are constructed to have a height measured from surface 30 which is substantially greater than the height of protrusions 34. With reference to FIG. 2, it can be seen that the height of protrusions 36 is constructed such that the height, $d_1$ of protrusions 36 plus the thickness, $d_2$ of strap body 15 between surfaces 30 and 32 is greater than the distance, $d_3$ (FIG. 2) between wall 23 of passage 22 and the distal extent 24*c* of barb 24. Also, distal extent 24*c* is constructed to have a width which engages protrusion 36 along strip 15*a*. Thus, upon insertion of strap 14 to passage 22, protrusions 36 engage distal extent 24*c* causing generally rotational deflection of barb 24 on cantilevered surface 26 in a clockwise direction as viewed in FIG. 2. Upon an attempt to withdraw strap 14 from passage 22 (arrow B), protrusions 36 catch distal extent 24*c* rotating barb 24 in a counter-clockwise direction and forcing distal extent 24*c* into biting engagement with strap body 15 preventing withdrawal of strap 14 through passage 22**.

Thus, in the embodiment shown in FIGS. 1 and 2 of the present invention, low insertion force of strap 14 through passage 22 is achieved by spacing the distal extent **24*c* of barb 24 from opposed passage wall 23 a distance not substantially less than the thickness of strap body 15 measured between surfaces 30 and 32. Further, sufficient pullout resistance and loop tensile strength is provided by the biting engagement of barb 24 with strap body 15 which is facilitated by the engagement of distal extent 24*c* with protrusions 36 upon an attempt to withdraw strap 14 from passage 22**.

Figure 4:
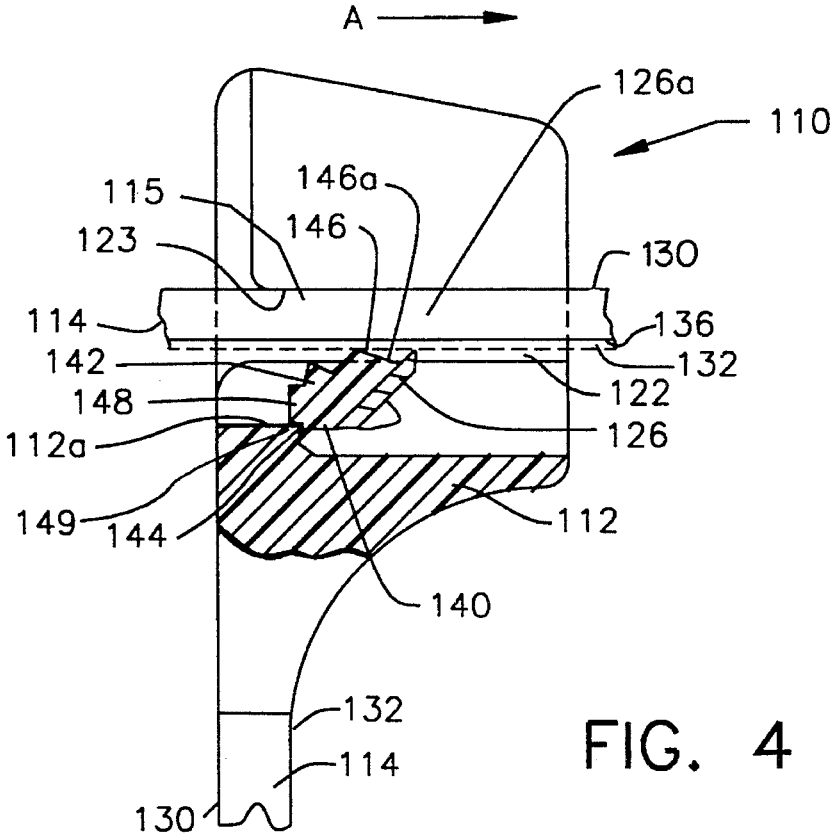
FIGS. 4 and 5 are cross-sectional showings of the head of one embodiment of a cable tie of the present invention shown in insertion position and withdrawal position, respectively.
Figure 5:
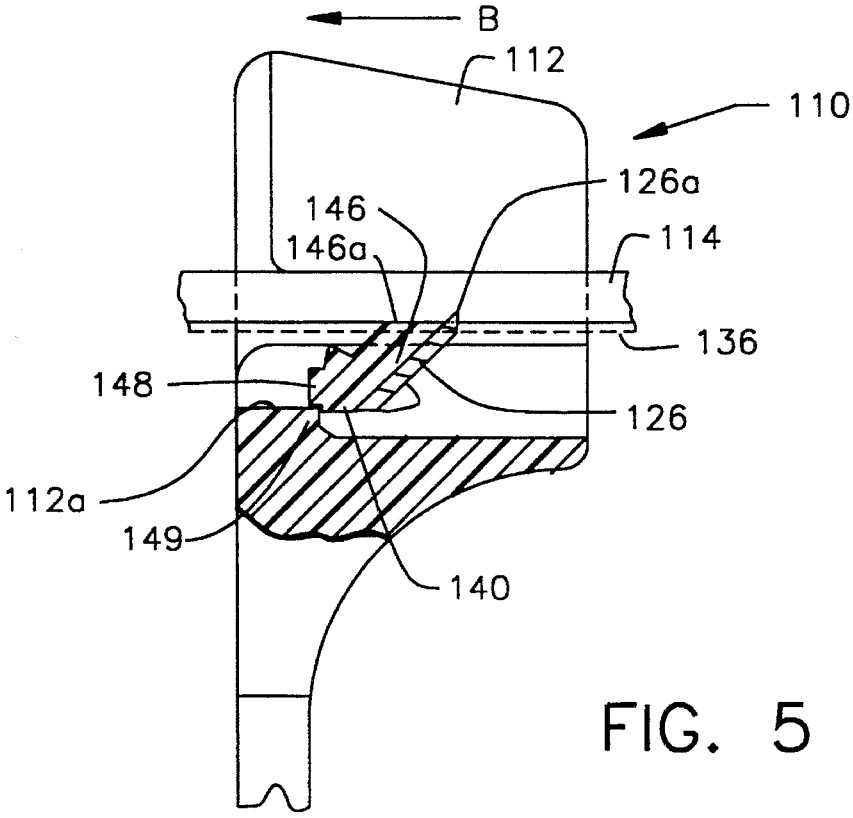

Referring now to FIGS. 4 and 5, the present invention may be practiced with reference to a further embodiment thereof FIGS. 4 and 5 show generally the head portion of a cable tie which has been modified from the configuration shown in FIGS. 1 and 2. Cable tie 110 includes a head 112 and a strap 114. Strap 114 includes a strap body 115 having opposed planar surfaces 130 and 132 with protrusions 136 (shown in phantom) extending from surface 132, protrusions 136 being similar to protrusions 36 shown in FIG. 3, A passage 122 through head 112 permits insertion of strap 114 therethrough in the direction of arrow A. An upper passage wall 123 engages surface 130 of strap 114 upon insertion of strap 114 through passage 122.

Head 112 is modified to include a pivotally mounted pawl 140 formed integrally with head 112. Pawl 140 supports metallic barb 126 which is secured therein such that distal extent **126*a* lies within passage 122. In a manner similar to that described above with respect to cable tie 10, distal extent 126*a* of barb 126 is positioned such that upon insertion of strap 114 in the direction of arrow A, distal extent 126*a* engages protrusions 136 extending from strap surface 132. As with cable tie 10, barb 126 is positioned such that the distance between distal extent 126*a* and passage wall 123 is not substantially less than the strap thickness measured between surfaces 130 and 132 so as to provide ease of insertion of strap 114 through passage 122. In that regard, head 112 of cable tie 110 includes integrally molded pawl 140 which supports barb 126 for flexible rotative movement within head 112. Pawl 140 includes a pawl body 142 attached to head 112 by a thin flexible hinge 144. Hinge 144 permits rotative movement of pawl body 142 and barb 126 supported thereby within head 112. Pawl body 142 includes an upper portion 146 adjacent barb 126. The upper portion 146 provides structural support for barb 126 and positions barb 126 for engagement with strap body 115. Upper portion 146 includes an upper planar surface 146*a* which extends into passage 122. Surface 146*a* is positioned from passage wall 123 a distance which is greater than the strap body thickness measured between surfaces 130 and 132 together with the distance of extending protrusions 136. Thus, upon insertion of strap 114 into passage 122 in the direction of arrow A, both strap body 115 and protrusions 136 are out of engagement with surface 146*a*. Thus, the only resistance to insertion of strap 114 is the light engagement of distal extent 126*a* of barb 126 with protrusions 136. The construction of pawl body 142 together with its attachment to head 112 by flexible hinge 144 permits low force insertion of strap 114 through passage 122 of head 112**.

Pawl body 142 further includes a rearwardly directed shoulder 148 separated from head 112 by an undercut 149. As will be described further hereinbelow, shoulder 148 and undercut 149 serve as a stop, preventing over-rotation of pawl 140 in a counter-clockwise manner upon an attempt to withdraw strap 114 from passage 122.

Referring now to FIG. 5, attempted withdrawal of strap 114 from passage 122 of head 112 is shown. As strap 114 is attempted to be withdrawn in the direction of arrow B, distal extent **126*a* of barb 126 catches against protrusions 136 extending from of strap body 115. Once such engagement is established, pawl 140 rotates in a counter-clockwise direction embedding the distal extent 126*a* of barb 126 into strap body 115. Further movement of strap 114 in the direction of arrow B is prevented by the biting engagement of barb 126 with strap body 115. Further, upon counter-clockwise rotation of pawl 140, surface 146a of pawl 140 wedges strap 114 against passage wall 123 providing retention of strap 114 in passage 122. Thus, in addition to preventing withdrawal of strap 114 by the biting insertion of barb 126 into strap body 115, resistance against withdrawal is enhanced by the wedging engagement of surface 146*a* with strap 114**.

Over-rotation of pawl 140 in the counterclockwise direction, which could result in over insertion of barb 126 into strap 114 or breakage of flexible hinge 144, is prevented by the collapsing of hinge 144 and the engagement of shoulder 148 with surface **112*a* of head 112. This provides a mechanical stop preventing over-rotation of pawl 140**.

Figure 6:
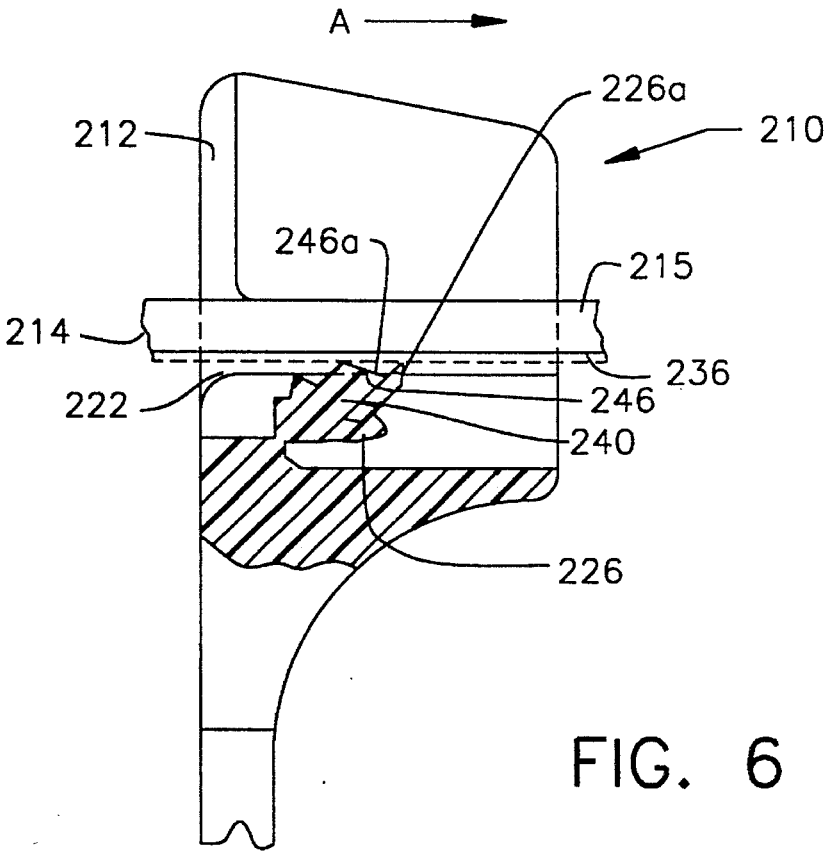
FIGS. 6 and 7 are cross-sectional views of the head of a further embodiment of the cable tie of the present invention in insertion position and withdrawal position, respectively.
Figure 7:
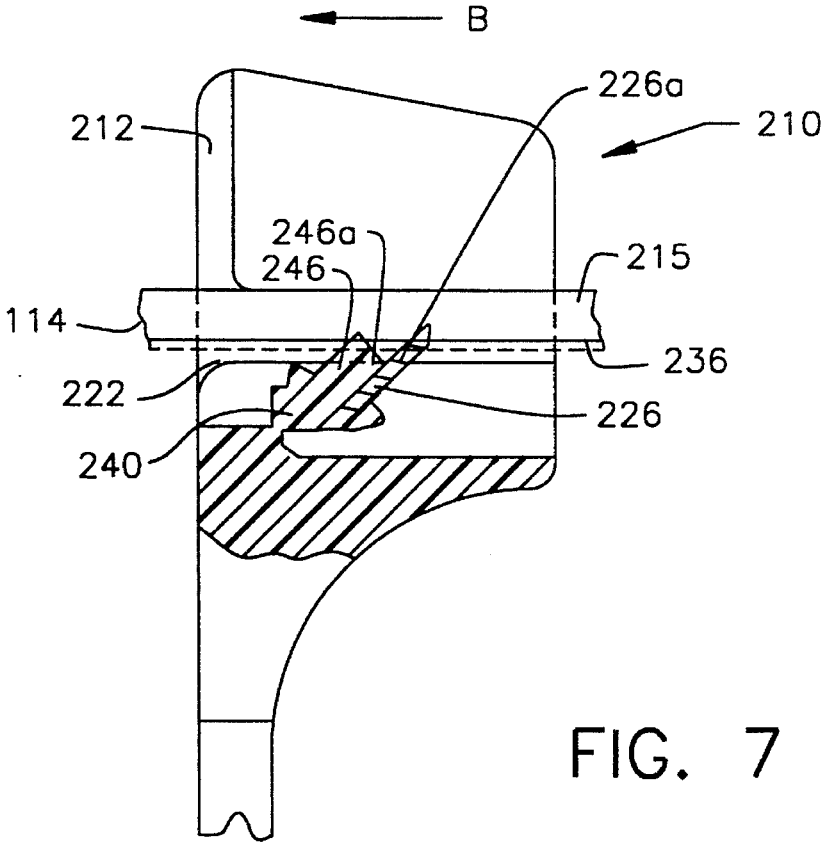

Referring now to FIGS. 6 and 7, a further embodiment of the present invention is shown. Cable tie 210 of FIGS. 6 and 7 is substantially similar to cable tie 110 shown in FIGS. 4 and 5. In this embodiment pawl 240 is modified so that the upper portion 246 is extended to provide an upper surface **246*a* which engages protrusions 236 of strap 214 upon insertion of strap 214 into aperture 222 in the direction of arrow A. In addition to the engagement of distal extent 226*a* of barb 226 with protrusions 236 of strap 114, upper surface 246*a* also provides frictional engagement against protrusions 236*a* upon insertion of strap 214** in the direction of arrow A.

Figure 8:
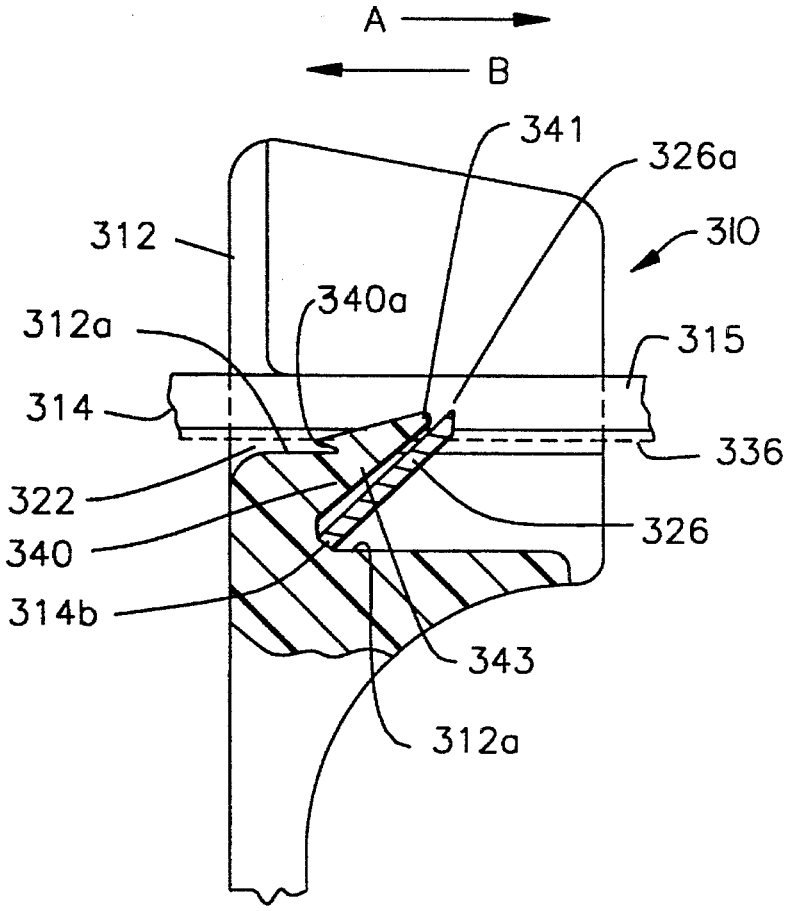
FIG. 8 is a cross-sectional view f the head of a still further embodiment of the present invention.

Upon an attempt to withdraw strap 214 from head 212 in the direction of arrow B, as shown in FIG. 7, further engagement between strap 114 and the barb pawl combination is achieved thereby increasing the tensile strength of the tie. Upon movement of strap 114 in the direction of arrow B, barb 226 bites into strap body 215 in a manner similar to that shown and described with respect to FIG. 5. Also, upper surface **246*a* of upper portion 246 engages strap body 215 to provide an increase in frictional resistance by the wedging action upon movement in the direction of arrow B. In situations where greater loop tensile strength is required, the design shown in FIGS. 6 and provides such increase in tensile strength while only minimally increasing the insertion force required to insert strap 214 through passage A still further embodiment of the present invention is shown with respect to FIG. 8. In this embodiment, barb 326 is embedded into head 312 of cable tie 310 adjacent surface 312*a*. A flexible barb support 340 is positioned adjacent barb 326. Barb 326 may be constructed in a manner described above to have a distal extent 326*a* which engages protrusions 336 of strap 314 upon insertion of strap 314 through passage 322. Barb support 340, positioned adjacent barb 326, includes a distal portion 341 which extends into passage 322 for engagement with protrusions 336 of strap 314 upon insertion thereof. The barb support 340 is flexibly constructed having a thin flexible hinge 343 and a tapering body extending toward distal portion 341, so as not to overly increase the insertion force of tie 310. Thus upon insertion (arrow A), barb support 340 easily deflects permitting passage of strap 314 therethrough. As with the embodiment shown with respect to FIGS. 4 and 5, upon withdrawal of strap 314 from head 312 (arrow B), barb 326 digs into strap body 315. Barb support 340 frictionally wedges strap 314** to provide increase withdrawal force resistance and loop tensile strength.

In the embodiment shown in FIG. S, barb 326 is embedded into head 312 at an end **314*b* opposite distal extent 326*a*. It has been found that in known ties having a similarly embedded barb upon attempt to withdraw the strap from the head, breakage of the barb at the point where it is embedded into the head may occur. This incidence of breaking may be caused by over flexing of the barb in the direction of arrow B. In this embodiment of the invention, a pawl support 340 supports barb 326 along nearly the entire length thereof. Such support prevents over flexing of barb 326 in the direction of arrow B. This support would tend to lessen the incidence of breakage of barb 326**.

In addition, and as similarly described with respect to the embodiment of FIGS. 4 and 5, over-rotation of the barb support 340 is prevented upon withdrawal of the strap 314 from the head 312 along the direction of arrow B. This over-rotation prevention is effected by the collapsing of hinge 343 and the engagement of shoulder surface **340*a* on barb 340 with inner surface 312*a* of head 312. Such engagement provides a mechanical stop for over-rotation of barb support 340**.

As set forth hereinabove, the present invention seeks to provide a barb flexibly positioned within a cable tie head such that a distal extent of the barb is spaced from the opposed passage wall a distance which permits the substantially unimpeded insertion of strap body through the passage in the cable tie head. In this regard it is desirable to space the distal extent of the barb from the passage wall a distance which is greater than the thickness of the strap body but less than the thickness of the strap body plus the extending protrusions. Thus upon insertion, the distal extent of the barb engages the protrusions and not the strap body. However in practice controlling such tolerances is difficult. Therefore the present invention contemplates forming a cable tie where the distance between the distal extent of the barb and the opposed passage wall is not substantially less than the thickness of the strap body as measured between the opposed surfaces. By controlling the positioning of the barb so that there is no more than insubstantial engagement of the distal extent of the barb with the strap body upon insertion of the strap into the head, a cable tie having an extremely low insertion force will be provided without sacrificing pullout resistance (loop tensile strength).

Various changes to the foregoing described and shown structures would now be evident to those skilled in the art. Accordingly, the particularly disclosed scope of the invention is set forth in the following claims.

What is claimed is:

1. A bundling tie comprising:

an elongate generally planar strap;

a head having an aperture therethrough for insertably accommodating said strap; and a locking device supported by said head and extending into said aperture, said locking device permitting movement of said strap in an insertion direction and preventing substantial movement of said strap in a withdrawal direction opposite said insertion direction;

said locking device including a flexibly mounted non-metallic support member extending into said aperture and a metallic barb supported adjacent said support member, said barb and said support member each being movable into locking engagement with said strap to prevent withdrawal of said strap in said withdrawal direction.

2. A bundling tie of claim 1 wherein said support member is integrally formed with said head.

3. A bundling tie of claim 2 wherein said support member is flexibly supported by a hinge and said support member supports said barb for hingeable movement therewith.

4. A bundling tie of claim 3 wherein said barb is engagable with said strap upon insertion of said strap into said aperture.

5. A bundling tie of claim 4 wherein said strap includes a planar strap surface and plural strap projections extending toward said locking device upon insertion of said strap into said aperture.

6. A bundling tie of claim 5 wherein said barb is engagable with said projections of said strap upon insertion of said strap into said aperture.

7. A bundling tie of claim 6 wherein said support member is out of engagement with said strap upon insertion of said strap into said aperture.

8. A bundling tie of claim 6 wherein said support member is engagable with said strap projections upon insertion of said strap into said aperture.

9. A bundling tie of claim 1 wherein said barb is secured within said support member for movement therewith.

10. A bundling tie of claim 1 wherein said barb is embedded within said head and is supported against said support member.

11. A bundling tie of claim 1 wherein said support member comprises a stop surface for engagement with an inner surface of said head to prevent over-rotation of said support member upon withdrawal of said strap in the withdrawal direction.

12. A bundling tie of claim 11 wherein said support member is supported by a flexible hinge that is of configuration to collapse upon withdrawal of said strap in the withdrawal direction, thereby facilitating engagement of said support member stop surface with said inner surface of said head.

13. A cable tie comprising:

an elongate member having a tail at one end, a head at the other end and a generally planar strap therebetween;

said head including an aperture therethrough for insertion of said tail and passage of said strap therethrough in a first direction; and locking means supported by said head and permitting insertable movement of said strap in said first direction and preventing movement of said strap in a second direction opposite said first direction upon an attempt to withdraw said strap from said aperture;

said locking means further including;

a hingedly mounted non-metallic support member extending from said head into said aperture; and a metallic locking barb supported adjacent said support member;

said locking barb and said support member each being movabley engagable with said strap upon said attempted movement of said strap in said second direction.

14. A cable tie of claim 13 wherein said barb includes a knife-like edge for biting engagement with said strap upon said attempted movement of said strap in said second direction.

15. A cable tie of claim 14 wherein said barb is non-lockingly engagable with said strap upon movement of said strap through said aperture in said first direction.

16. A cable tie of claim 15 wherein said support member is integrally formed with said head.

17. A cable tie of claim 16 wherein said support member includes:

a flexible hinge pivotally extending from said head;

a barb holding member at an end of said hinge holding said barb for pivotal movement within said aperture.

18. A cable tie of claim 17 wherein said barb holding member includes an engagement portion for frictional engagement with said strap upon said attempted movement of said strap in said second direction.

19. A cable tie of claim 15 wherein said support member is frictionally engagable with said strap upon movement of said strap through said aperture in said first direction.

20. A cable tie of claim 15 wherein said strap includes a planar strap surface and plural projections extending from said planar surface toward said locking means upon insertion of said strap in said aperture.

* * * * *